US005704664A

United States Patent [19]

Naumovski

[11] Patent Number: 5,704,664

[45] Date of Patent: Jan. 6, 1998

[54] DOOR SECURITY DEVICE

[76] Inventor: Branko Naumovski, 944 Monte Carlo Court, Mississauga, Ontario, Canada, L5C 3M1

[21] Appl. No.: 606,729

[22] Filed: Feb. 27, 1996

Related U.S. Application Data

[63] Continuation-in-part of Ser. No. 288,605, Aug. 10, 1994, abandoned.

[51] Int. Cl.[6] ..... E05C 19/18

[52] U.S. Cl. ..... 292/288; 292/291; 292/297

[58] Field of Search ..... 292/288, 289, 292/293, 295, 297, 290, 291; 269/239, 268, 270

[56] References Cited

U.S. PATENT DOCUMENTS

| | | | |
|---|---|---|---|
| 350,437 | 10/1886 | Kirchner | 292/293 |
| 540,423 | 6/1895 | Chivill | 292/293 |
| 1,105,473 | 7/1914 | Walker | 269/239 |
| 4,285,535 | 8/1981 | Leary | 292/293 |
| 4,406,488 | 9/1983 | Polselli | 292/293 |
| 4,462,624 | 7/1984 | Zanzonico | 292/289 |
| 4,619,447 | 10/1986 | Blake | 269/239 |
| 4,673,174 | 6/1987 | Tabbert | 269/268 |
| 5,462,322 | 10/1995 | Berezansky | 292/288 |

*Primary Examiner*—Steven N. Meyers
*Assistant Examiner*—Gary Estremsky
*Attorney, Agent, or Firm*—Anthony Asquith & Co.

[57] ABSTRACT

The device is used for security by e.g the occupier of a hotel room. A toggle-type self-gripping mechanism is provided with thin jaw-blades. The blades are entered into the slot or gap between a door and a door jamb. The jaws engage the door-bolt, and the device enables a heavy gripping clamp to be applied to the bolt. The thin jaws do not buckle under the heavy clamping because they are constrained against buckling by the slot. A screw-clamp may be substituted for the toggle-clamp.

10 Claims, 8 Drawing Sheets

DOOR SECURITY DEVICE

This application is a Continuation-in-Part of application Ser. No. 08/288,605, filed Aug. 10, 1994 now abandoned. This invention relates to a device for improving the security with which doors can be locked against unauthorized entry.

BACKGROUND TO THE INVENTION

The device is intended for use particularly by persons staying in hotel rooms, or the like, where the possible danger arises that a thief may try to force the door, or a person with a pass-key to the door may try to obtain unauthorized entry.

The device is applied by the occupier of a room, from the inside. The device is used in conjunction with a pre-existing door bolt. The bolt may be of the type that is manually applied, and is separate from the key-operated lock of the door, or the device may be used in conjunction with a bolt associated directly with a key-operated lock. The device may also be used on latch-bolts found in wedge/spring type latch mechanisms.

GENERAL FEATURES OF THE INVENTION

The invention lies in a door-bolt security device, which is based on the familiar and conventional toggle-type self-gripping mechanism. The device comprises a main lever, a handle, and a toggle strut, arranged in the usual way in such devices.

In the invention, the device includes jaw-blades, which are of hard, thin, sheet steel. The sheet steel is thin enough to fit into the kind of gap or slot obtaining between a door and a door jamb.

The two jaw-blades are flat, and are co-planar, and the two jaw-blades lie in a plane perpendicular to the axis of the main pivot of the device, ie the pivot of the main lever to the handle.

The thin jaw-blades are arranged to be passed into the slot between a door and its door jamb. In that slot, the jaw-blades are arranged to clamp around the door-bolt. A heavy gripping clamp force can be built up between the jaws, but the jaw-blades do not buckle because the blades are supported and constrained between the door and the door jamb.

THE INVENTION IN RELATION TO THE PRIOR ART

There are many known devices which are based on the operation of the toggle-type self-gripping mechanism. Typical of these is that shown in U.S. Pat. No. 3,184,838 (Johnson, 1965). The device of the present invention is distinguished from such previous proposals by the structure and arrangement of the jaws, as arranged for the purposes described herein. Of interest also is U.S. Pat. No. 4,136,589 (Kerr, 1979) in which the self-gripping mechanism is used to hold a (door-)key.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
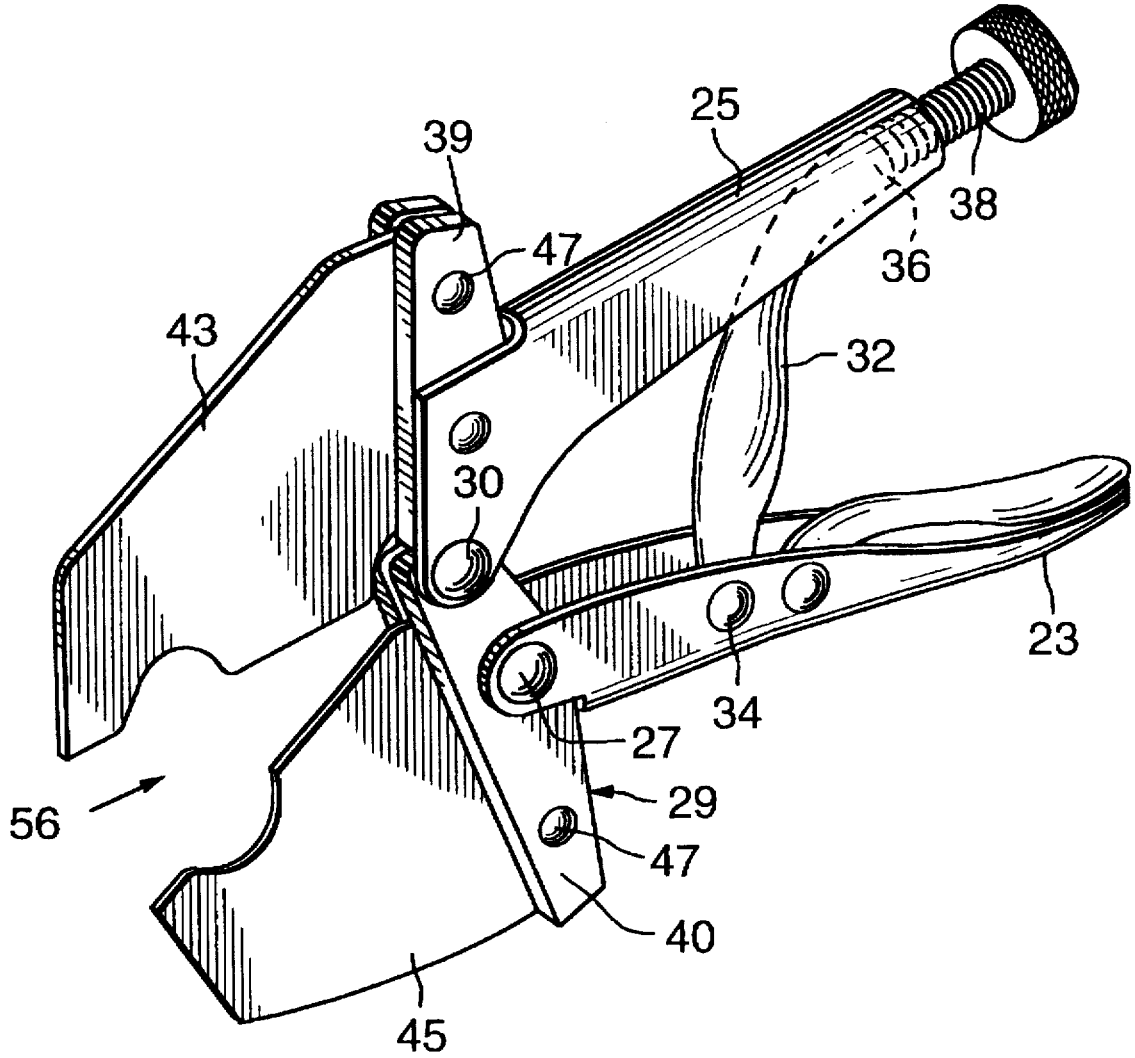
FIG. 1 is a pictorial view of a door-bolt gripping security device that embodies the invention.

The device 20 shown in FIG. 1 is based on a conventional self-gripping mechanism, which may be described briefly as follows. A main lever 23 and a handle 25 are arranged for squeezing together. The main lever is pivoted at 27 to a jaw-lever 29, which is in turn pivoted, at 30, to the handle 25. A strut 32 is pivoted at 34 to the lever 23, and the strut 34 abuts, at its other end 36, against an adjustable screw 38 in the handle 25. Jaw-bases 39,40 are formed integrally one to the handle 25, and the other as a compone t of the jaw-lever 29.

Jaw-blades 43,45 are attached to the jaw-bases 39,40 by means of rivets 47.

The geometry of the self-gripping mechanism is such that when the handle 25 and main lever 23 are squeezed together, the pivot 27, the pivot 34, and the abutment at 36, become aligned in a straight line. The jaw-blades 43,45 lie at a specific distance apart when this straight-line condition is reached. The person using the device adjusts the screw 38 until the distance apart of the jaw-blades at the straight-line condition is a little less than the width of the item being gripped between the jaw-blades.

The strut 32, when nearing the straight-line condition, is acting as a toggle arm approaching its dead-centre. As such, the mechanical advantage of the handle-to-lever (23–25) force as against the jaw-to-jaw (43–45) force, becomes very high, as the straight-line condition is approached and reached. The conventional self-gripping mechanism owes its wide acceptability and usage to the fact that not only can a person leave the tool with the gripping force retained therein, but, because of the high mechanical advantage, the person needs only a small effort to achieve a very high jaw-to-jaw gripping force.

It is recognised that these are the very qualities required in the device having the function as described herein.

In the present case, the device is required to grip a door-bolt so tightly that a thief trying to force the door from outside cannot move the bolt. A considerable gripping force is required to achieve this end. Of course, in the present device, the ability for the device to retain the gripping force, when released, also is essential.

It is noted that the jaw-to-jaw gripping force that can be achieved by a person having a reasonable strength of the hands, is of the same order of magnitude as the jaw-to-jaw gripping force on a door bolt which is needed to ensure a good level of security, ie to prevent the door-bolt from being forced.

The jaw-blades 43,45 are of sheet metal (steel), having a thickness of about 1.5 mm. Ordinarily, it is not possible for such thin jaw-blades to exert a gripping force of the magnitude required, because thin jaw-blades simply buckle and bend aside at much smaller forces than that. A thin jaw-blade can only exert forces at that level if it is supported or confined against buckling.

It is recognised that in use of the present device the jaw blades are in fact confined and constrained against buckling, even at high gripping forces, by the fact that the jaw-blades, when in use, lie in the narrow gap or slot between the door and the door jamb. The narrow slot between the door and the door jamb provides the constraint which confines the jaw-blade against buckling. If the slot were substantially wider than the jaw-blade, the blade would be permitted to buckle within the space allowed.

The thickness of the blade material should be a little less than the width of the slot. Of course, the width of the slot varies with different door installations; it has been found that a blade thickness of about 1.5 mm is able to fit into the slots as encountered in real doors, in nearly every case. As mentioned, the thickness of the jaw-blade as dictated by the width of the slot ordinarily found in doors, provides an adequate strength of blade to grip the bolt, given that the blade is supported by the slot.

In fact, the user should take care not to apply full force to the jaw-blades when the blades are outside the slot, since then there would be a real chance the jaw-blades might buckle.

A blade thickness of more than about 2 mm means that the device can only be used in those cases where the slot between the door and the door jamb is unusually wide. A blade thickness of less than about 1 mm means that the blade is too flimsy to exert a large enough force on the door-bolt, even though the jaw blade is confined against buckling within the slot.

Figure 2:
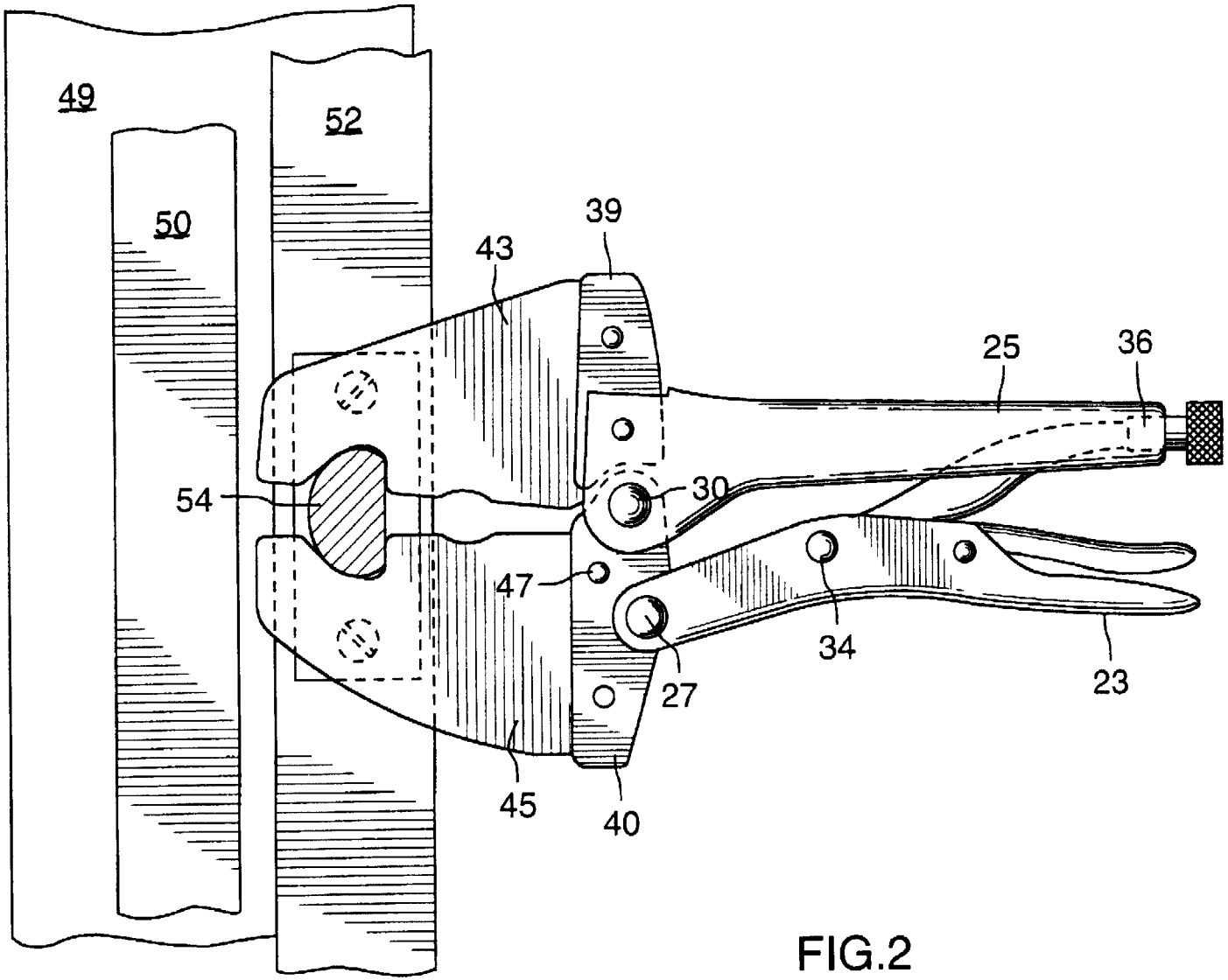
FIG. 2 is a side elevation of a door and door jamb combination, to which the device of FIG. 1 has been applied.

FIG. 2 shows a side elevation of a door jamb 49, to which is attached the usual door-abutment-strip 50. The door 52 opens inwards, ie to the right in FIG. 2, and the abutment strip 50 defines the limit-stop against which the door moves upon closing. Upon the door being closed against the abutment strip, the door-bolt 54 enters a complementary bolt-hole (not shown) in the door jamb 49. The door-bolt 54 may be advanced into the bolt-hole by the turning of a key in a lock, or by manual manipulation of the bolt, or by wedge/spring latch action, as determined in the case of the particular door.

Figure 3:
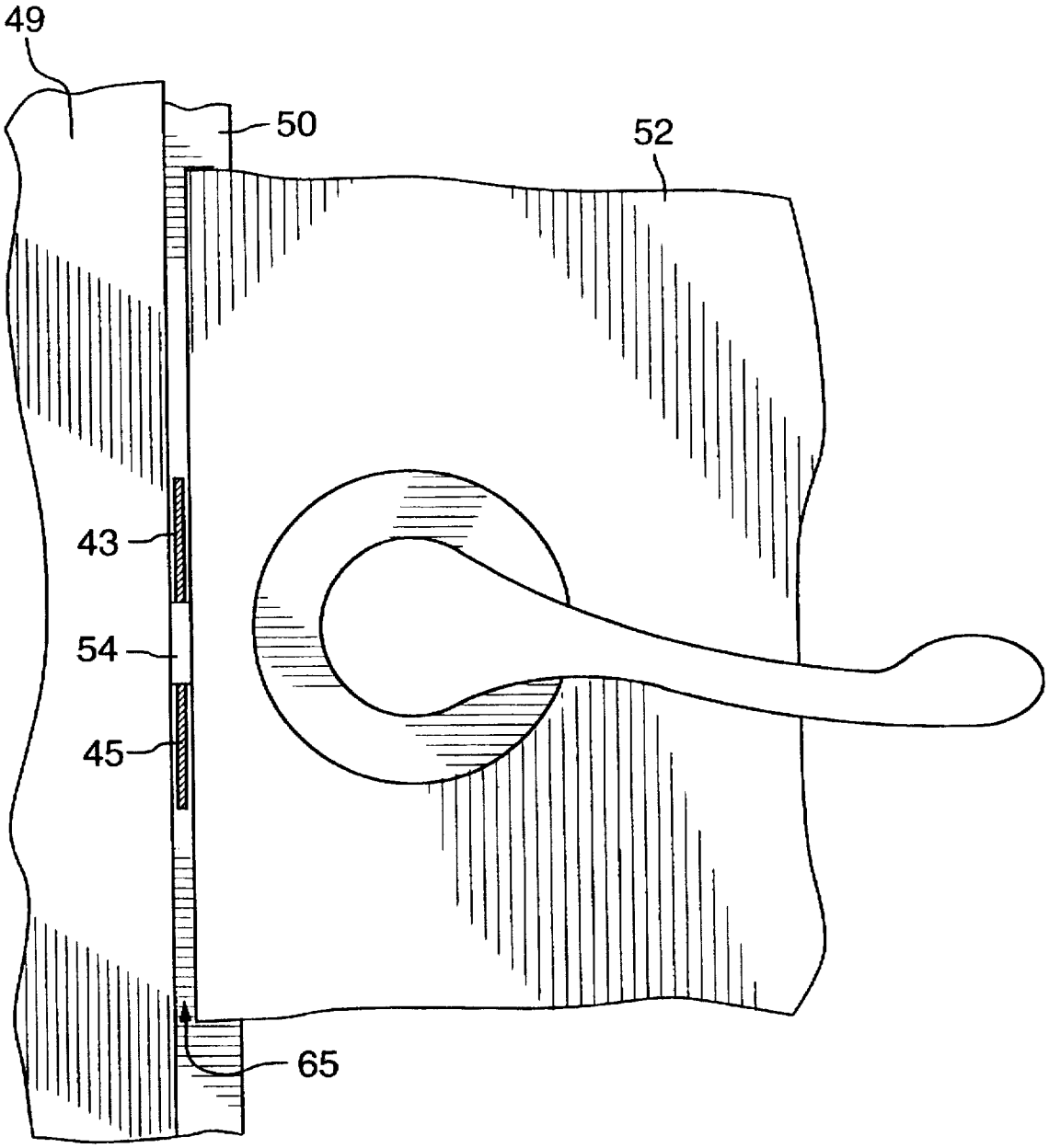
FIG. 3 is a front elevation of the combination of FIG. 2.

Door-bolts vary as to size and cross-sectional shape. However, it has been found that the size and shape of cut-out openings 56 in the jaw-blades 43,45 as shown will serve for most types of door-bolt. The length 58 of the rounded cut-out should be about 15 mm, and the depth 60 also about 15 min. There should be 3 or 4 cm of free blade (distance 63) between the cut-out 56 and the thicker jaw-bases 39,40, to allow the jaw-blades to be inserted far enough into the slot 65 between the door 52 and the door jamb 49 (FIG. 3) to be sure of clamping around the bolt 54. The jaw-blades 43,45 should protrude (at 67) no more than about 5 mm beyond the cut-out 56.

The material of the jaw-blades should be of hard steel, heat-treated for strength. It is preferred that the jaw-blades should be hard enough to dig in (slightly) into the material of the door-bolt: often, though, door-bolts are themselves made of hard steel.

Figure 4:
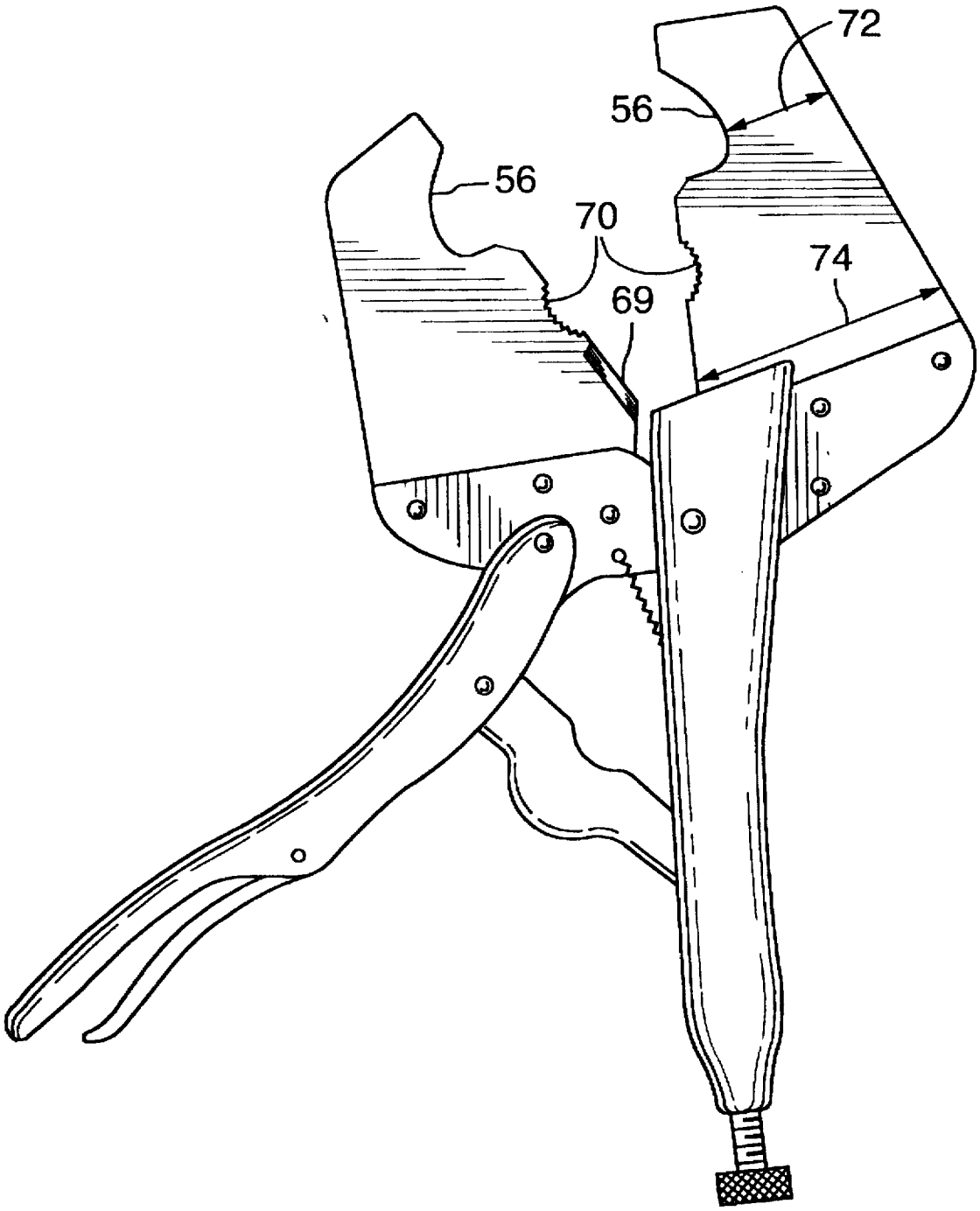
FIG. 4 is a view of a device similar to that shown in FIG. 1.
Figure 5A:
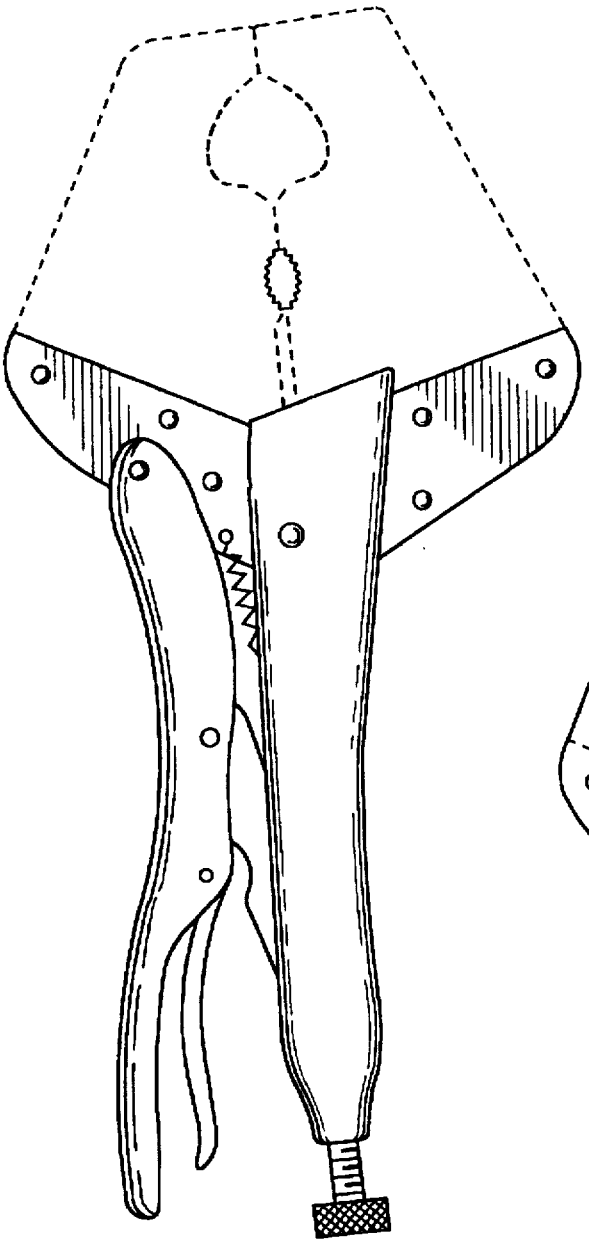
FIGS. 5A and 5B show the device of FIG. 4 is different operative configurations.
Figure 5B:
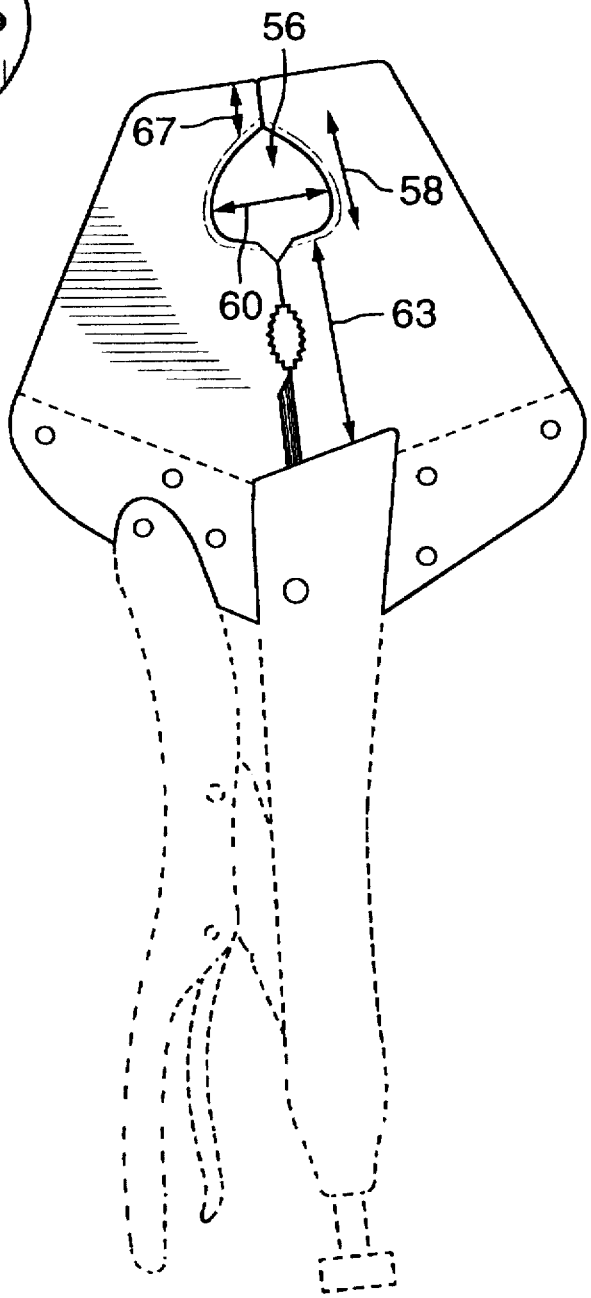
Figure 6:
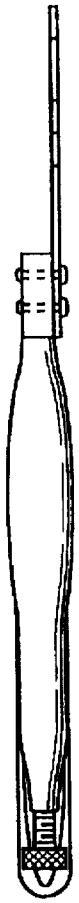
FIG. 6 is a side view of the device of FIG. 4.
Figure 7:
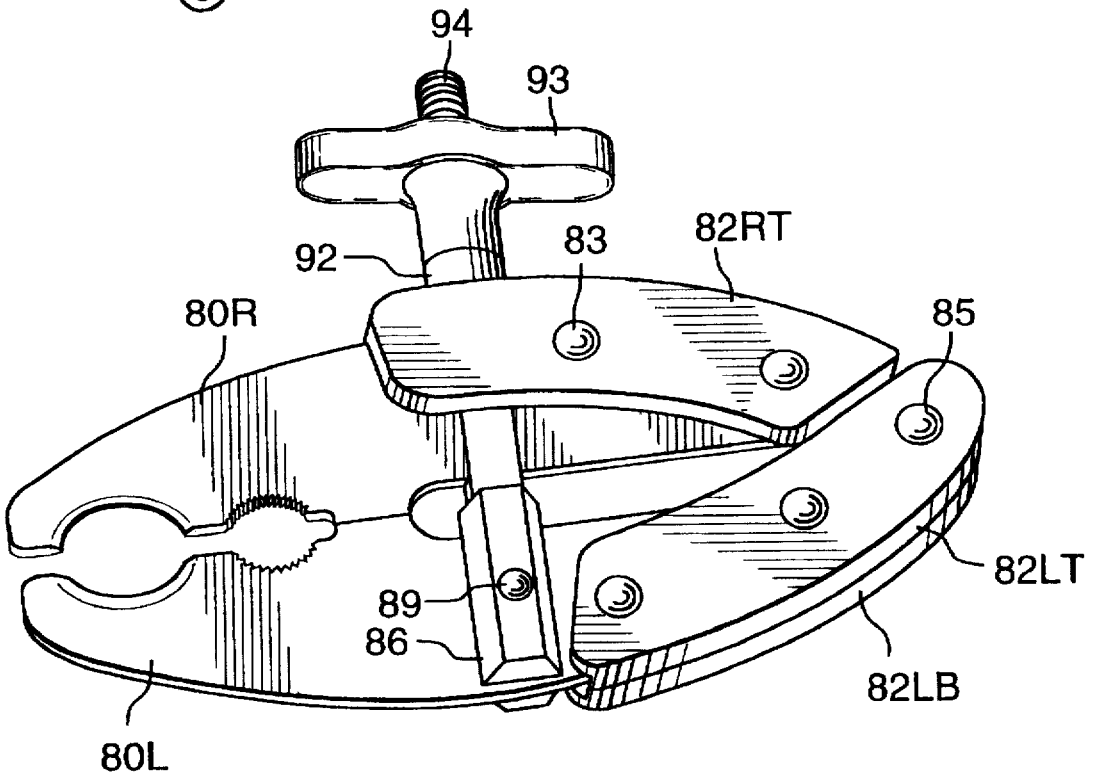
FIG. 7 is a pictorial view of another device which embodies the invention.
Figure 8:
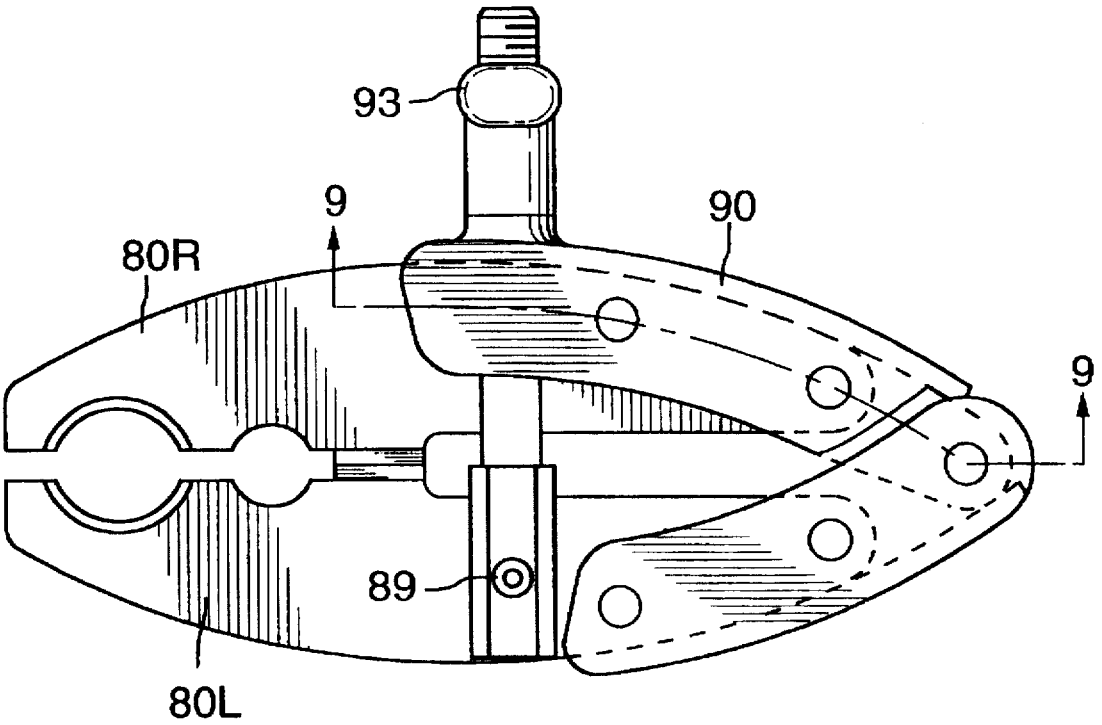
FIG. 8 is a plan view of the device of FIG. 7.

The material of the jaw blade preferably is hard enough that a corner of the jaw blade can serve as a screw driver, and also so that a sharpened edge, as at 69 in FIG. 4, can serve as a cutter. Another cut-out 70 in the jaw-blades, positioned in the unused space inside the bolt cut-out, can serve as a wire stripper, or as general (light duty) pliers.

Because the thin sheet metal of the jaw-blades is supported against buckling by being inserted in the slot 65, it is worthwhile to add a good depth of metal in the plane of the jaws. (Such depth of metal could not be taken advantage of if the jaw-blade were not supported against buckling.) The jaw-blade should be at least 1 cm deep (preferably 1.5 cm) outside the cut-out 56 at 72, and 3 cm deep (preferably 4 cm) near the base, at 74.

The device as described is portable and light in weight. The device can easily fit into a person's luggage or briefcase, or even into a lady's handbag. The security provided by the device amply compensates for any minor inconvenience of carrying the device.

The device is inexpensive, and may be adjusted, in use, to suit a wide variety of sizes and types of door-bolt (although door-bolts really do not differ very much as to size and shape). The device, under the right conditions, and having been installed properly, gives extremely good security against unauthorised entry.

It will be noted that, with the use of the device, entry is denied even to persons equipped with a duplicate key or a master-key. Even though the regular opening mechanism of the door is totally disabled by the device, the performance of the regular mechanism is not impeded or interfered with, and is left just as it was upon removal of the device.

In the case where a room door is not fitted with a sliding-bolt, the device can be applied to the common wedge/spring latch bolt; very few doors, at least doors of the type likely to be encountered in a room in which a person might want to be secure, would lack a bolt of some kind, to which the device may be applied.

FIGS. 7, 8, 9, 10 show a further embodiment of the invention. Flat thin jaw-blades 80L,80R are present, as previously described. The jaw-blades are made of metal, preferably a hard stainless steel.

The left jaw-blade 80L is clamped and mounted between plastic mouldings, being a top moulding 82LT and a bottom moulding 82LB. The bottom moulding is formed with pegs 83, which are sized to be a tight interference fit inside corresponding bosses 84 in the top moulding 82LT. The jaw-blade 80L is formed with holes, whereby the jaw-blade fits over the pegs.

The top and bottom mouldings 82LT,82B are engaged together, and the fit of the pegs 83 in the bosses 84 is tight enough, when the mouldings are pressed together, to keep the mouldings assembled and locked together, with the jaw blade 80L held therebetween.

The same description applies to the right jaw blade 80R and the respective top and bottom mouldings 82RT,82RB.

Figure 9:
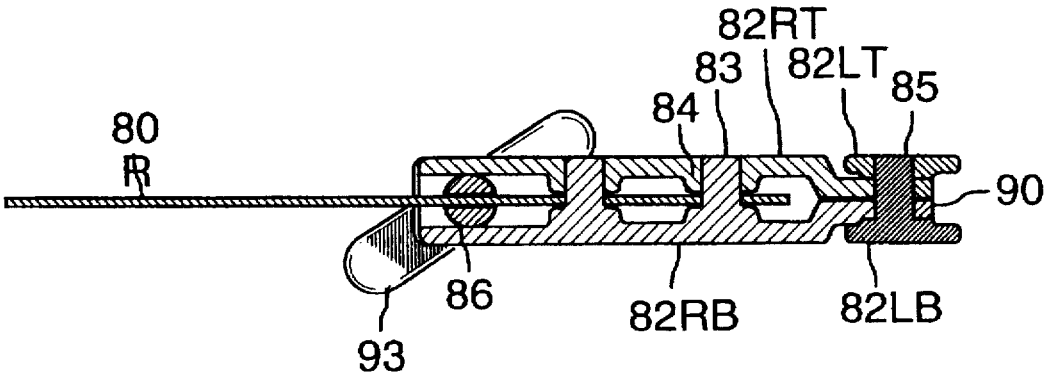
FIG. 9 is a cross-section on line 9—9 of FIG. 8.
Figure 10:
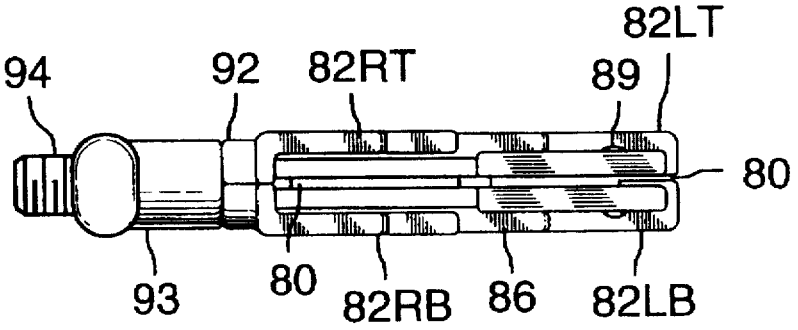
FIG. 10 is a front elevation of the device of FIG. 7.

The plastic mouldings extend rearwards, and are brought together to form a pivot point 85. As shown in FIG. 9, the four mouldings lie in a stack at the pivot point 85, whereby pivoting motion can take place between the left mouldings 82LT,82LB and the right mouldings 82RT,82RB.

Figure 11:
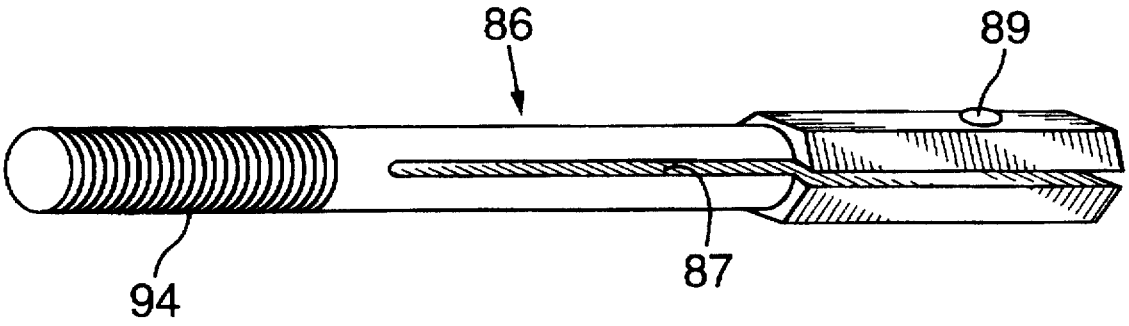
FIG. 11 is a view of one of the components of the device of FIG. 7.

The device includes a slit bolt 86, which is shown in FIG. 11. The slit 87 in the bolt 86 is wide enough to accommodate the thickness of the jaw-blade. The bolt 86 is attached to the left jaw-blade 80L by means of a riveted through-pin 89, which permits the bolt to pivot with respect to the jaw-blade. The slit 87 is long enough to extend over both jaw-blades, and to permit opening and closing movements of the jaw-blades.

Figure 12:
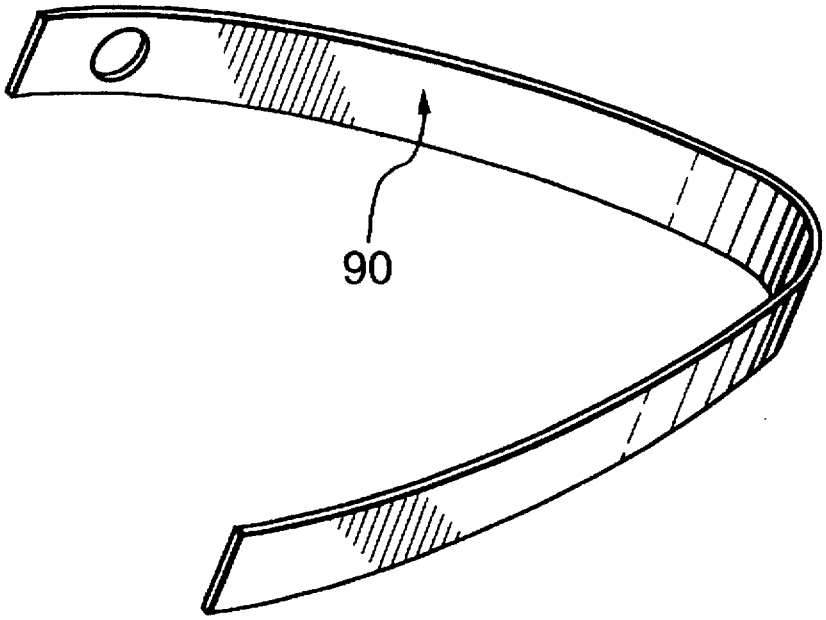
FIG. 12 is a view of another component of the device of FIG. 7.

FIG. 12 shows a spring leaf 90, which is arranged to resiliently urge the jaw-blades apart.

The two right mouldings 82RT.82RB, when pressed together, form a cylindrical abutment 92. A hand-nut 93 is threaded to the non-slit end 94 of the slit bolt 86. When tightened, the hand-nut lies against the abutment 92.

In operation, a person applies the jaw-blades into the gap between the door and the door jamb, as previously described. The jaw-blades are tightened down onto the door-bolt by tightening the hand-nut 93.

It will be understood that the form of the slit bolt 86, in which the jaw-blades lie in the slit, is such as to maintain the two jaw-blades flat and co-planar. As previously described, the door jamb gap serves to resist buckling of the thin jaw-blades as a heavy clamp is applied: the slit bolt 86 similarly also serves, by its shape, to resist buckling of the jaw-blades.

It will be understood also that the components of the device are held together, and maintained in alignment, by the use of just one riveted pin 89. The rest of the connections are made simply by pressing the plastic mouldings together.

The device is light enough to be carried in a hand bag or the like, and yet the device is strong enough that a heavy clamp force can be applied to the door-bolt.

In FIGS. 7–12, the bolt 86 comprises a support member for supporting the thin blades against buckling. The bolt 86 and the hand-nut 93 comprise a manually-operable means for pressing the jaws together, and a means for holding and retaining the jaw-blades gripped to the door bolt.

I claim:

1. A door bolt security device including;

two jaw-levers and a main pivot;

the main pivot defining a main pivot axis, the structure of which enables the jaw-levers to undergo relative pivoting movement, the jaw-levers being mutually co-planar and lying in a plane perpendicular to the axis of the main pivot, the jaw-levers including jaw-blades which are of thin sheet metal, the jaw-blades including jaws that are disposed towards one end of the respective jaw-levers, wherein the jaws are structured for gripping a door bolt between the jaws when the door is closed;

the device also including a handle means for receiving a force derived from the hand of a person operating the device so as to transform that hand force into a gripping force acting between the jaws so as to grip a door-bolt between the jaws, and an operable force-locking means including a screw and a nut which in use act on the jaw-levers for retaining the gripping force up to a magnitude F, after the person has released the handle means, the screw having a slit along its length, the slit receiving the sheet metal of the jaw-blades therein with a tight fit to prevent buckling of the jaw-blades, the screw and nut being mounted on the device so as to ensure that the gripping force arising from the screw and nut is applied to the jaw-levers in the plane of the sheet metal of the jaw-blades, in that the line of action of the gripping force lies within the thickness of the sheet metal of the jaw-blades, and wherein the jaw-blades are so thin that the magnitude F of the gripping force is sufficient to cause the thin sheet metal of the jaw-blades, if not constrained, to buckle.

2. A door-bolt security device, in which:

the device includes jaws, comprising jaw-blades, which are of hard, thin, sheet metal; the sheet-metal jaw-blades are flat, co-planar, and are thin enough, so as to be adapted to fit into the kind of gap or slot that is typical between a closed door and a corresponding door-jamb;

the sheet metal jaw-blades are so shaped and adapted as to be suitable for operative gripping engagement with the bolt of a door;

the device includes jaw-levers, on which the jaw-blades are respectively disposed;

the jaws are disposed towards one end of the respective jaw-levers;

the device includes a main pivot, having a main pivot axis, the structure of which enables the jaw-levers to undergo relative pivoting movement;

the two jaw-blades are mutually co-planar, and lie in a plane perpendicular to the axis of the main pivot;

the device includes a handle means for receiving a force derived from the hand of a person operating the device, and for transforming that hand force into a force for pressing the jaw-blades together onto the door-bolt with sufficient force that the jaws grip the door-bolt forcefully enough to hold the bolt against unauthorized movement of the door-bolt;

the device includes a clamping means for holding and retaining the jaw-blades gripped to the door-bolt with the said sufficient force, even when the handle means is released, and wherein the means for holding and retaining the jaw-blades gripped to the door-bolt comprises a screw and nut;

the screw and nut also comprise a jaw-blades support means for preventing buckling of the jaw-blades in that, the screw is formed with a slit along its length, and the slit overlies the sheet metal of the jaw-blades, the slit screw having a tight fit over the sheet metal so as to prevent buckling of the jaw-blades, and the screw and nut being mounted on the device so as to ensure that the force arising from the screw and nut is applied to the jaw-blades in the plane of the sheet metal of the jaw-blades, in that the line of action of the said clamp force lies within the thickness of the sheet metal of the jaw-blades.

3. Device of claim 2, wherein the jaw-blades are between 1 mm and 2 mm thick.

4. Device of claim 3, wherein the jaw-blades are about 1.5 mm thick.

5. Device of claim 2, wherein the jaw-blades are provided with cut-outs which are suitable for engagement with the door-bolt.

6. Device of claim 5, wherein the cut-outs in the jaw-blades form a rounded cavity about 1.5 cm long and about 1.5 cm deep.

7. Device of claim 5, wherein the jaw-blades are formed with a substantial depth of metal outside the cut-outs.

8. Device of claim 7, wherein the said depth is at least 1 cm.

9. Device of claim 2, wherein the arrangement of the device is such that the main pivot lies at the end of the jaw levers remote from the jaws, and the screw lies at an intermediate location between the pivot and the jaws.

10. Device of claim 2, wherein, in respect of each jaw-blade, the depth of the jaw-blade, being the dimension measured in the plane of the sheet metal of the jaw-blade along the line of action of the said force on the door-bolt, is at least 1 cm.

* * * * *